United States Patent [19]

Naoi et al.

[11] 4,455,362

[45] Jun. 19, 1984

[54] PREPARATION OF ENCAPSULATED ELECTROSTATOGRAPHIC TONER MATERIAL

[75] Inventors: Takashi Naoi; Fujio Kakimi, both of Shizuoka, Japan

[73] Assignee: Fuji Photo Film Co., Ltd., Kanagawa, Japan

[21] Appl. No.: 444,308

[22] Filed: Nov. 24, 1982

[30] Foreign Application Priority Data

Nov. 27, 1981 [JP] Japan ..... 56-190236

[51] Int. Cl.[3] ..... G03G 9/08

[52] U.S. Cl. ..... 430/137; 430/110; 427/212; 427/218; 427/219; 427/221; 427/222

[58] Field of Search ..... 430/110, 137; 427/212, 427/214, 218, 219, 221, 222

[56] References Cited

U.S. PATENT DOCUMENTS 4,139,483 2/1979 Williams et al. ..... 430/110

FOREIGN PATENT DOCUMENTS 54-8535 1/1979 Japan ..... 430/110
57-53756 3/1982 Japan ..... 430/137
1462181 1/1977 United Kingdom ..... 427/212

OTHER PUBLICATIONS

Khanna, "Surfactant-Free Emulsion Polymerization Process", Res. Discl. Jul. 1977, p. 56.

*Primary Examiner*—Roland E. Martin, Jr.
*Attorney, Agent, or Firm*—Toren, McGeady and Stanger

[57] ABSTRACT

In a process for the preparation of an electrostatographic toner material comprising encapsulating a core material containing colorant with a shell material in an aqueous medium to prepare encapsulted toner particles and drying the so prepared encapsulted toner particles, the improvement which comprises washing the encapsulated toner particles with an aqueous solution of a surface active agent in advance of subjecting them to the drying procedure.

5 Claims, No Drawings

PREPARATION OF ENCAPSULATED ELECTROSTATOGRAPHIC TONER MATERIAL

This invention relates to a process for the preparation of an electrostatographic toner material, and more particularly relates to a process for the preparation of a pressure fixable electrostatographic toner material comprising encapsulated toner particles.

There is known the electrostatography which comprises developing a tone electrostatic latent image contained on a photoconductive or dielectric surface with a toner material containing colorant and a fixing aid to produce a visible toner image, and transferring and fixing the visible toner image onto a surface of a support medium such as a sheet of paper.

The development of the latent image to produce a visible toner image is carried out by the use of either a developing agent consisting of a combination of toner material with carrier particles, or a developing agent consisting of toner material only. The developing process utilizing the combination of toner material and carrier particles is named "two component developing process", while the developing process utilizing only the toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither the heating procedure nor the solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is said to be an advantageous fixing process inherently having a variety of preferable features.

However, the pressure fixing process also has a variety of inadvantageous features. For instance, the pressure fixing process generally provides poorer fixability than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of the pressing roller.

There has been preveously proposed an encapsulated toner material which comprises toner particles enclosed with micro-capsules, so as to overcome the above-described disadvantageous features of the pressure fixing process. The encapsulated toner material is prepared by enclosing core particles (containing colorant such as carbon black) with shells which are rupturable by the application of pressure. The so-prepared encapsulated toner material has various advantageous features; for instance, the fixing of the encapsulated toner material does not require very high pressure, and the fixability is excellent. Accordingly, the encapsulated toner material is viewed as suitable for the use in the pressure fixing process. However, the encapsulated toner materials proposed up to now appear unsatisfactory in practical use, because they are not able to satisfy some of the characteristics required for providing smooth copying and duplicating operation and for accomplishing excellent toner image fixability and quality.

More in detail, it is required for the toner material for the use as a dry type developing agent in the electrostatography to have excellent powder characteristics (or, powder flow properties) to provide high development quality, and to be free from staining the surface of the photosensitive material on which the latent image is formed. The term "powder characteristics" particularly means resistance to agglomeration and blocking of the toner particles. In the process for the preparation of an encapsulated toner material, the toner material is generally separated from a toner dispersed solution and dried through a spray-drying procedure. The previously known encapsulated toner material is apt to undergo agglomeration either in the spray-drying process, or in the storage period after the spray-drying. The so agglomerated toner material markedly degrades the resolution of the visible toner image produced on the electrostatographic latent image, whereby markedly decreasing the sharpness of the visible toner image fixed onto the support medium.

Further, a toner material employed for the two component developing process is also required not to stain the surface of the carrier particles. The toner material for the use as a developing agent in the pressure fixing process is furthermore required to be satisfactory in the fixability under pressure and not to undergo offsetting against the roller surface, that is, phenomenon in which the toner adheres to the roller surface so as to stain it.

The encapsulated toner materials proposed until now are not satisfactory, at least, in one of these requirements for the developing agent to be employed for the pressure fixing process.

It is, accordingly, an object of the invention to provide a process for the preparation of an electrostatographic toner material free from the drawbacks described above.

It is another object of the invention to provide a process for the preparation of an encapsulated toner material suitably employed for the pressure fixing process and free from the drawbacks described above.

It is a further object of the invention to provide a process for the preparation of an encapsulated toner material suitably employed for the pressure fixing process, whose powder characteristics are remarkably improved.

It is a still further object of the invention to provide a process for the preparation of an encapsulated toner material having improved pressure fixability in addition to the improved powder characteristics.

It is a still further object of the invention to provide a process for the preparation of an encapsulated toner material having improved resistance to the offsetting in addition to the improved powder characteristics and the improved pressure fixability.

It is a still further object of the invention to provide a process for the preparation of an encapsulated toner material which is resistant to rupture prior to the pressing operation in the pressure fixing process, while which is easily rupturable in the pressure fixing operation.

The above-described objects and other objects which will be apparent from the hereinafter-given description are accomplished by the present invention, that is, in a process for the preparation of an electrostatographic toner material comprising encapsulating a core material containing colorant with a shell material in an aqueous medium to prepare encapsulated toner particles and drying the so prepared encapsulated toner particles, the improvement which comprises washing the encapsulated toner particles with an aqueous solution of a surface active agent in advance of subjecting them to the drying procedure.

The shell material prepared in the invention is made of a polymer. Examples of the polymer employable as the shell material include a variety of resins such as polyurethane, polyamide, polyester, polysulfonamide, polyurea, epoxy resin, polysulfonate and polycarbonate. Preferred are polyurethane and polyurea.

The shell can be composed substantially of a complex layer. For instance, the shell can be comprised of two or more polymers selected from the group consisting of polyurethane, polyurea and polyamide.

The encapsulation of the core material in the form of droplets with the shell material can be done by a known method for preparing the so-called micro-capsule containing a hydrophobic liquid, such as an interfacial polymerization method as described in U.S. Pat. Nos. 3,577,515, and 3,429,827, and British Pat. Nos. 950,443, 1,091,077 and 1,091,078; an inner polymerization method as described in U.S. Pat. Nos. 3,660,304, 3,726,804, 3,796,669 and 2,969,330; a phase separation method in an aqueous medium as described in U.S. Pat. Nos. 2,800,457, 2,800,458, 3,041,289, and 3,205,175; an outer polymerization method as described in U.S. Pat. Nos. 4,087,376, 4,089,802, 3,100,103, and 4,001,140; and a fusion-dispersion-cooling method as described in U.S. Pat. No. 3,167,602. Other known encapsulating methods and modifications and combinations of these encapsulating methods can be also employed.

The shell material of the toner particle according to the invention is preferably produced by a polymerization reaction between two or more compounds.

The encapsulation of the invention is preferably accomplished by one of the two encapsulating methods, namely, the interfacial polymerization method and the inner polymerization method.

The interfacial polymerization method can be done in the following manner.

In the first place, the following two substances are selected:

Substance (A) which as such is a hydrophobic liquid or a substance soluble, miscible or well dispersable in a hydrophobic liquid; and Substance (B) which as such is a hydrophilic liquid or a substance soluble, miscible or well dispersable in a hydrophilic liquid, in which Substance (A) can react with Substance (B) to produce a polymerization reaction product insoluble in either the hydrophobic liquid or the hydrophilic liquid.

In the second place, very small droplets of a hydrophobic liquid including Substance (A) and the core materials such as a colorant and a pressure fixable adhesive material (binder), and having an average diameter in the range from about 0.5 to about 1,000 microns are dispersed into a hydrophilic liquid such as water containing Substance (B), in the presence of a protective colloid prepared from, for instance, a hydrophilic polymer.

A catalyst can be incorporated in either or both of the hydrophobic liquid and the hydrophilic liquid.

The substance (A) is caused to react with Substance (B) to undergo interfacial polymerization in the dispersion by an appropriate procedure, for instace, by heating the dispersion. Thus, the shells of polymerization reaction product of Substance (A) with Substance (B) and/or water are formed around the hydrophobic droplets including the core material and the colorant, and accordingly the encapsulation of the core material and the colorant with the shell is accomplished to produce encapsulated toner particles in the aqueous phase.

Examples of Substance (A) preferably employed for the preparation of the shell in the invention include compounds carrying isocyanate groups described below:

(1) Diisocyanate m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidynediisocyanate, cyclohexylene-1,2-diisocyanate, cyclohexylene-1,4-diisocyanate, p-phenylenediisocyanate, triphenylmethanediisocyanate;

(2) Triisocyanate 4,4',4''-triphenylmethanetriisocyanate, polymethylenepolyphenyltriisocyanate, toluene-2,4,6-triisocyanate;

(3) Tetraisocyanate 4,4'-dimethyldiphenylmethane-2,2',5,5'-tetraisocyanate; and (4) Polyisocyanate prepolymer an addition product of hexamethylene diisocyanate and hexanetriol, an addition product of 2,4-tolylenediisocyanate and catechol, an addition product of 2,4-tolylenediisocyanate and hexanetriol, an addition product of 2,4-tolylenediisocyanate and trimethylolpropane, an addition product of xylylenediisocyanate and trimethylolpropane.

Examples of the Substance (B) preferably employed for the preparation of the shell in the invention include compounds described below:

(1) Water;

(2) Polyol ethylene glycol, 1,4-butanediol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'-bis(4-hydroxyphenyl)butane, 2,2'-bis(4-hydroxyphenyl)-isopentane, 1,1'-bis(4-hydroxyphenyl)-cyclopentane, 1,1'-bis(4-hydroxyphenyl)-cyclohexane, 2,2'-bis(4-hydroxy-3-methylphenyl)-propane, bis(2-hydroxyphenyl)-methane, xylylenediol, ethyleneglycol, 1,3-propylene glycol, 1,4-butylene glycol, 1,5-pentanediol, 1,6-heptanediol, 1,7-heptanediol, 1,8-octanediol, trimethylolpropane, hexanetriol, pentaerythritol, glycerol, sorbitol;

(3) Polyamine ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, an addition product of an epoxy compound and an amine compound; and (4) Piperazine piperazine, 2-methylpiperazine, 2,5-dimethylpiperazine.

In the preparation of the dispersion of the very small hydrophobic droplets containing Substance (A) and the core material, the hydrophobic liquid to be dispersed preferably contains a low-boiling solvent or a polar solvent. These solvents serve for accelerating formation of the shell which is a reaction product between the Substance (A) and the Substance (B). Examples of these solvents include methyl alcohol, ethyl alcohol, diethyl ether, tetrahydrofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

The encapsulated toner material whose shell is composed substantially of a complex layer comprising two or more polymers selected from the group consisting of polyurethane, polyurea and polyamide can be produced as follows:

In a hydrophobic liquid comprising core materials such as a colorant, and a pressure fixable adhesive material (binder), are dissolved an acid chloride and a polyisocyanate. This solution is then dispersed in an aqueous medium comprising a polyamine or piperazine and a dispersing agent to produce fine droplets of the core material having an average diameter in the range from about 0.5 to about 1,000 microns in the aqueous medium.

The dispersion produced above is then neutralized or made weak-alkaline by addition of an alkaline substance, and subsequently heated to a temperature between 40° and 90° C. Upon completion of these procedure, a complex layer consisting substantially of a polyamide and a polymethane, in which the polyamide is a reaction product produced by reaction between the acid chloride and the polyamine, and the polyurea is a reaction product produced by reaction between the polyisocyanate and the polyamine, is formed around the droplet of core material. Thus, the encapsulated particle having the complex layer shell is obtained.

If a polyol is further added to the hydrophobic liquid in the above, there is produced around the hydrophobic core material droplet a complex layer shell consisting substantially of the polyamide and a polyurethane, in which the polyurethane is a reaction product of the polyisocyanate with the polyol.

In the latter procedure, a complex layer consisting substantially of the polyamide, polyurea and polyurethane can be produced, if the polyamine is introduced into the reaction system in an amount exceeding the amount required to react the introduced acid chloride.

The shell of the so produced particle is, as described above, a complex layer shell. The term "complex layer shell" means a shell comprising a polymer mixture, as well as a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

Examples of acid chlorides include adipoyl chloride, sebacoyl chloride, phthaloyl chloride, isophthaloyl chloride, terephthaloyl chloride, fumaroyl chloride, 1,4-cyclohexanedicarbonyl chloride, 4,4'-biphenyldicarbonyl chloride, 4,4'-sulfonyldibenzoyl chloride, phosgene, polyesters containing acid chloride groups, and polyamides containing acid chloride groups.

The acid chloride can be replaced with a dicarboxylic acid or its acid anhydride. Examples of the dicarboxylic acids include adipic acid, sebacic acid, phthalic acid, terephthalic acid, fumaric acid, 1,4-cyclohexanedicarboxylic acid and 4,4'-biphenyldicarboxylic acid. Examples of the acid anhydrides include phthalic anhydride.

The inner polymerization method can be done in the following manner.

In a hydrophobic liquid to form the core material of the encapsulated toner particle are dissolved substance (A) and one or more substances polymerizable with the Substance (A) so as to produce a shell material, in the presence of a low boiling solvent or a polar solvent. The so obtained hydrophobic liquid is dispersed and emulsified in the aforementioned hydrophilic liquid which is not miscible with the hydrophobic liquid. The emulsion is then heated to cause removal of the low boiling solvent or polar solvent to the outside of the hydrophobic liquid droplet and simultaneously to move the shell-forming substances to the surface of the droplet. The shell-forming substances are polymerized at the surface to prepare the desired shell. Thus, the desired encapsulated toner particles dispersed in the hydrophilic liquid are obtained.

As for the other aspects of the interfacial polymerization method and the other processes for the preparation of micro-capsules containing a hydrophobic liquid, there are given descriptions in U.S. Pat. No. 2,726,804, which is introduced hereinto as reference.

The core material of the invention contains colorant for producing a visible image from the latent image. The colorant generally is a dye or a pigment, but a certain agent providing no directly visible image such as a fluorescent substance can be employed as the colorant, if desired.

The colorant is generally selected from a variety of the dye, pigment and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative colorant, that is generally called Diazo Yellow; and red colorants such as Rhodamine B Lake that is a double salt of xanthin dye with phosphorus wolframate and molybdate, Carmine 6B belonging to Azo pigment, and a quinacridone derivative.

The core material of the invention further contains a binder (adhesive material) for keeping the colorant within the core and assisting the fixing of the colorant onto the surface of a support medium such as paper. The binder is generally selected from high-boiling liquids conventionally employed or proposed for employment for finely dispersing an oil-soluble photographic additive within an aqueous medium to incorporate the additive into a silver halide color photosensitive material, or selected from polymers proposed for employment as the binders for the pressure fixable encapsulated toner materials.

Examples of the high-boiling liquids include the following compounds having the boiling point of higher than 180° C.:

(1) Phthalic esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphthalene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acid

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

The above-listed high-boiling liquids and examples of other high-boiling liquids employable in the invention are described in detail in the following publications:

Japanese Patent Publication Nos. 46(1971)-23,233 and 49(1974)-29,461; Japanese Patent Provisional Publication Nos. 47(1972)-1,031, 50(1975)-62,632, 50(1975)-82,078, 51(1976)-26,035, 51(1976)-26,036, 51(1976)-26,037, 51(1976)-27,921, and 51(1976)-27,922; U.S. Pat. Nos. 2,322,027, 2,353,262, 2,533,514, 2,835,579, 2,852,383, 3,287,134, 3,554,755, 3,676,137, 3,676,142, 3,700,454, 3,748,141, 3,837,863, and 3,936,303; British Pat. Nos. 958,441, 1,222,753, 1,346,364, and 1,389,674; and West Germany Offenlegungsschrift No. 2,538,889.

For the purpose of the invention, the high-boiling liquid is preferably selected from the phthalic acid esters, phosphoric acid esters and alkylnaphthalenes.

Examples of the polymers include the following polymers:

polyolefins, olefin copolymers, polystyrene, styrenebutadiene copolymer, epoxy resins, polyesters, natural and synthetic rubbers, polyvinylpirolidone, polyamides, cumarone-indene copolymer, methyl vinyl ether-maleic anhydride copolymer, maleic acid-modified phenol resin, phenol-modified terpene resin, silicone resins, epoxy-modified phenol resin, amino resins, polyurethane elastomers, polyurea elastomers, homopolymers and copolymers of acrylic acid ester, homopolymers and copolymers of methacrylic acid ester, acrylic acid-long chain alkyl methacrylate copolymer oligomer, poly(vinyl acetate), and poly(vinyl chloride).

The above-listed polymers and examples of other polymers employable in the invention are described in detail in the following publications:

Japanese Patent Publication Nos. 48(1973)-30,499, 49(1974)-1,588 and 54(1979)-8,104; Japanese Patent Provisional Publication Nos. 48(1973)-75,032, 48(1973)-78,931, 49(1974)-17,739, 51(1976)-132,838, 52(1977)-98,531, 52(1977)-108,134, 52(1977)-119,937, 53(1978)-1,028, 53(1978)-36,243, 53(1978)-118,049, 55(1980)-89,854 and 55(1980)-166,655; and U.S. Pat. Nos. 3,788,994 and 3,893,933.

The core material of the invention can further contain a magnetizable substance, preferably in the form of fine particles.

As for the magnetizable substances, there are given descriptions, for instance, in Japanese Patent Provisional Publication Nos. 53(1978)-118,053, 53(1978)-1,028 and 55(1980)-166,655. Examples of materials of the magnetizable substances include metals such as cobalt, iron and nickel; metal alloys or metal compositions comprising aluminum, cobalt, copper, iron, lead, magnesium, nickel, tin, zinc, gold, silver, antimony, beryllium, bismuth, cadmium, calcium manganese, titanium, tungsten, vanadium and/or zirconium; metallic compounds including metal oxides such as aluminium oxide, ferric oxide, cupric oxide, nickel oxide, zinc oxide, zirconium oxide, titanium oxide and magnesium oxide; refractory metal nitrides such as chromium nitride; metal carbides such as tungsten carbide and silica carbide; ferromagnetic ferrite; and their mixtures.

A releasing agent can be further contained in the core material for keeping the ruptured shell and the released core material from adhering to the surface of the pressing roller. The releasing agent can be chosen from those proposed for employment in the previously reported encapsulated toner materials. Examples of the releasing agents include a fluorine-containing resin described in Japanese Patent Provisional Publications Nos. 55(1980)-142,360 and 55(1980)-142,362.

As mentioned hereinbefore, a process for the preparation of the encapsulated toner particles include a stage for dispersing or emulsifying very small droplets of the hydrophobic liquid containing one or more of the shell-forming substances and the core material in the aqueous medium. For the preparation of the homogeneous dispersion (or, emulsion) of the very small droplets of the hydrophobic liquid, it is preferred to incorporate into the reaction liquid a hydrophilic protective colloid which assist the production of the homogeneous dispersion (or, emulsion) of the hydrophobic droplets and prevention of agglomeration of the so-produced hydrophobic droplets. The hydrophilic protective colloid can be employed alone or in combination.

Examples of substances preferably employable for the preparation of the hydrophilic protective colloid include proteins such as gelatin, graft polymers of gelatin and other polymers, albumin, and casein; cellulose derivatives such as hydroxyethylcellulose, carboxymethylcellose, and cellulose sulfuric acid ester; saccharide derivatives such as sodium alginate, gum arabic, and starch derivatives; and a variety of synthetic hydrophilic homopolymers and copolymers such as polyvinyl alcohol, partially acetalized polyvinyl alcohol, poly-N-vinyl pyrrolidone, polyacrylic acid, polyacrylic amide, polyvinylimidazole and polyviylpyrazole.

In the above-listed examples, the gelatin can be a lime-treated gelatin, an acid-treated gelatin, a hydrolyzed gelatin, and an enzymically decomposed gelatin. The graft polymers of gelatin and other polymers can be gelatins carrying graft chains consisting of homopolymers or copolymers of vinyl monomers such as acrylic acid, methacrylic acid, their derivatives, e.g., esters and amides, acrylonitrile, and styrene. Examples of the gelatin graft polymers ae those miscible with gelatin such as the gelatin carrying the graft chains consisting of polymer of acrylic acid, methacrylic acid, acrylamide, methacrylamide or hydroxyalkyl methacrylate.

Details of these preferred gelatin graft polymers are described in U.S. Pat. Nos. 2,763,625, 2,831,767, and 2,956,884.

Representative examples of the synthetic hydrophilic polymers are described, for instance, in West German Offenlegungsschrift No. 2,312,708 U.S. Pat. Nos. 3,620,751 and 3,879,205, and Japanese Patent Publication No. 43(1968)-7,561.

Dispersing or emulsifying the reaction liquid can be carried out by means of a known homogenizer such as one belonging to the stirring type, the high pressure injecting type, the ultrasonic vibrating type or the kneader type. Particularly preferred homogenizers are a colloid mill, a conventional homogenizer, and an electromagnetic distortion inducing ultrasonic homogenizer.

The encapsulated toner is then produced, for instance, by heating the emulsified reaction liquid in the presence of an appropriate catalyst, as described hereinbefore, so as to form shells around the core material droplets. Subsequently, the encapsulated toner is separated from the aqueous reaction medium and dried to obtain a dry encapsulated toner.

According to the process of the invention, the encapsulated toner particles are washed with an aqueous solution of a surface active agent in advance of subjecting them to the drying procedure.

Examples of the surface active agents include nonionic surface active agents, for instance, natural surface active agents such as saponin (steroide type), alkylene oxide derivatives such as polyethylene glycol, polyethylene glycol/polyproylene glycol condensation product, alkyl- or alkylarylether of polyethylene glycol, polyethylene glycol esters, polyethylene glycol sorbitol ester, alkylamine or amide of polyalkylene glycol, polyethylene oxide adduct of silicone polymer, glycidol derivatives such as polyglyceride alkenylsuccinate and alkylphenol polyglyceride, fatty acid esters of polyhydric alcohols, alkylesters of saccharide, urethanes and ethers; anionic surface active agents having acidic groups such as carboxy, sulfo, phospho, sulfate ester and phosphate ester groups, for instance; triterpenoidetype saponin, alkylcarboxylic acid salts, alkylsulfonic acid salts, alkylbenzenesulfonic acid salt, alkylnaphthalenesulfonic acid salts, alkylsulfate esters, alkylphosphate esters, N-acyl-N-alkyl-taurines, sulfosuccinic acid esters, sulfoalkyl-polyoxyethylene alkylphenyl ethers, and polyoxyethylene alkylphosphate esters; cationic surface active agents, for instance, higher alkylamines, quaternary ammonium salts, pyridine and other heterocyclic compounds, phosphonium and sulfonium; and amphoteric surface active agents, for instance, amino acids, aminosulfonic acids, and sulfate- or phosphate-esters of aminoalcohol. Preferred are nonionic surface active agents and anionic surface active agents.

The above-mentioned surface active agents and other surface active agents employable in the invention are described in "Synthesis and Application of Surface Active Agent" (Ryouhei Oda & Kazuhiro Teramura; Maki Shoten, Japan) and "Surface Active Agents" (A. W. Perry; Interscience Publications Inc., New York).

Examples of the surface active agents employable in the invention are given below:

Nonionic Surface Active Agent

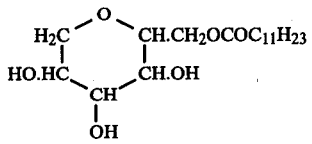

(1)

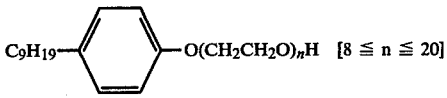

(2)

$C_{12}H_{25}—O—(CH_2.CH_2O)_{10}H$ (3)

$C_{16}H_{33}—O—(CH_2.CH_2O)_{10}H$ (4)

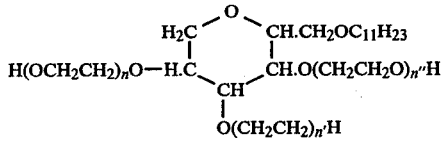

(5)

[n + n' + n'' = 20]

Anionic Surface Active Agent

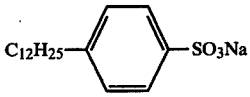

(6)

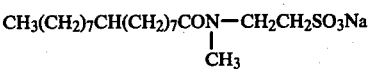

(7)

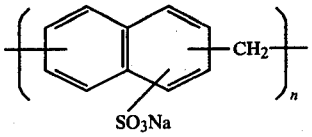

(8)

-continued (9)

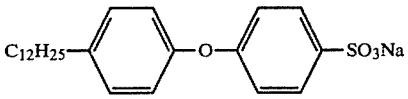

(10)

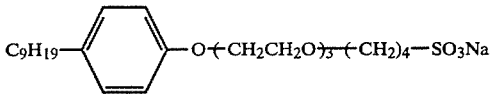

(11)

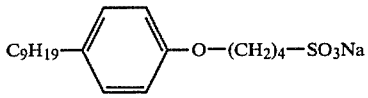

(12)

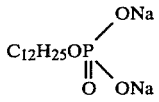

(13)

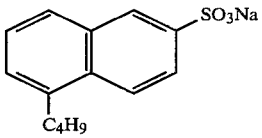

(14)

$C_{12}H_{25}O.SO_3Na$ (15)

$$\begin{array}{l} CH_2.COOC_8H_{17} \\ | \\ CH.COOC_8H_{17} \\ | \\ SO_3Na \end{array}$$

(16)

$$\begin{array}{l} \quad\quad CH_2-COOC_6H_{11} \\ \quad\quad\quad | \\ NaO_3S-CH.COOC_6H_{11} \end{array}$$

(17)

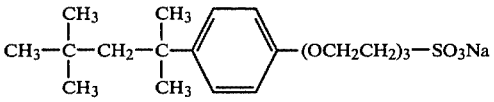

Cationic Surface Active Agent (18)

$[(CH_3)_3{\equiv}N-C_{18}H_{37}]^+Cl^-$ (19)

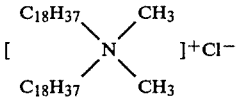

Amphoteric Surface Active Agent (20)

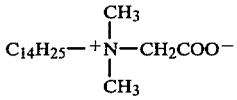

(21)

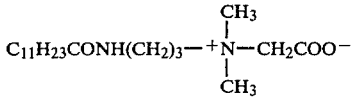

(22)

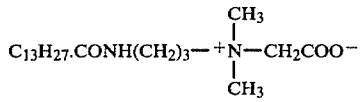

The surface active agent can be employed singly or in combination.

In the invention, the concentration of the surface active agent in the aqueous solution preferably ranges from 0.3 to 10 percent by weight, and more preferably ranges from 0.5 to 2 percent by weight. There is no limitation on the amount of the aqueous solution of the surface active agent to be employed for washing the encapsulated toner particles, but generally the aqueous solution is employed in the amount of ½–5 times as much as the solid content of the encapsulated toner particles (total amount of the shell and core material of the encapsulated toner particles).

After completion of washing the encapsulated toner particles with the aqueous solution of the surface active agent, the drying procedure is applied to the encapsulated toner particles. The drying procedure can be carried out by a known process such as the spray-drying process or the freeze-drying process. The spray-drying process is preferred.

The so-produced dry encapsulated toner can be admixed with an insulating material and/or a charge controller such as a metal-containing dye or Nigrosin dye.

A dry encapsulated toner can be admixed with a flow lubricant such as hydrophobic silica powder so that the flow lubricant can be dispersed over the surface of the encapsulated toner. The encapsulated toner having the flow lubricant such as hydrophobic silica powder over the toner surface shows particularly improved powder quality and property, and accordingly is very advantageous in the practical use.

The encapsulated toner obtained as above can be introduced into the electrostatographic copying and duplicating machine to develop an electrostatographically produced latent image so as to produce a visible toner image on the surface of the photoconductive material. The visible image is then fixed onto a support medium such as paper by means of an appropriate pressure fixing apparatus. There is no limitation on the pressure fixing apparatus for fixing the encapsulated toner of the invention, and any known apparatus can be applied to the fixing of the encapsulated toner of the invention. Examples of the pressure fixing apparatuses include those illustrated in Japanese Patent Publications Nos. 44(1969)-9,880, 44(1969)-12,797, and 46(1971)-15,876; and Japanese Patent Provisional Publications Nos. 49(1974)-62,143, 49(1974)-77,641, 50(1975)-51,333, 51(1976)-31,235, 51(1976)-40,351, 52(1977)-15,335, 52(1977)-102,743, 54(1979)-28,636, 54(1979)-32,326, 54(1979)-41,444, and 54(1979)-48,251.

The electrostatographic toner material prepared according to the invention has improved powder characteristics, and further is resistant to the mechanical shock and abrasion in the developing apparatus of the electrostatographic copying and duplicating machine. Further, the electrostatographic toner material is easily rupturable in the pressure fixing apparatus to produce a visible toner image well fixed onto the support medium such as paper. Furthermore, the toner material hardly undergoes off-setting to a pressing roller and hardly undergoes the so-called filming on the surfaces of the carrier particles, the developing sleeves and the photoconductive material.

Other features of the electrostatographic copying and duplicating process employing an encapsulated toner material are described in U.S. Pat. No. 3,788,994, which is introduced hereinto as reference.

The present invention will be illustrated by the following examples which are by no means intended to introduce any restriction into the invention.

Example 1

Into a dispersion of 3 g. of carbon black in 27 g. of dibutyl phthalate was introduced 10 g. of a mixture of acetone and methylene chloride (1:3, volume ratio), and the mixture was then admixed to become homogeneous.—Primary liquid.

Subsequently, 4 g. of an adduct of hexamethylene diisocyanate with hexanetriol (3:1 molar ratio adduct) and 0.05 g. of dibutyltin laurate (catalyst) were added to the primary liquid at a temperature of not higher than 25° C.—Secondary liquid.

Independently, 3 g. of gum arabic was dissolved in 57 g. of water at 20° C., and into this solution under vigorous stirring was poured little by little the secondary liquid. Thus, there was obtained an oil-in-water emulsion containing oily droplets having average diameter of 10–15 μm. The procedure for the preparation of the emulsion was carried out under cooling the reaction vessel for keeping the temperature of the emulsion below 20° C.

To the emulsion was further added under stirring 100 g. of water heated to 40° C. After completion of the addition of water, the emulsion was gradually heated to 90° C. over 30 min. The emulsion was kept under stirring at the temperature for 20 min. so as to complete the encapsulating reaction.

The so prepared dispersion was subjected to centrifugal separation at 5,000 r.p.m. to separate the encapsulated particles from the gum arabic-containing aqueous solution. The separated slurry containing the encapsulated particles was divided into three portions, that is, A, B and C.

The portion B was washed with an aqueous solution of an anionic surface active agent having the formula:

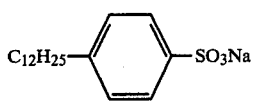

in water (concentration: 1 wt. %), and the portion C was washed with an aqueous solution of an anionic surface active agent having the formula:

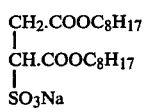

in water (concentration: 1 wt. %), while the portion A was left untreated.

To each portion was added 100 cc of water, and the resulting slurry was dried in a spray-drying apparatus to obtain a powdery encapsulated toner material.

Each of the toner materials obtained from the portions A, B and C was examined on the powder characteristics. Microscopic observation on the toner materials B and C indicated for both materials that most of the toner particles were present independently and that no bulky agglomerated particles were formed, while microscopic observation on the toner material A indicated that not a few particles agglomerated producing relatively bulky particles.

The evaluations of the toner materials A and B were carried out as follows.

Five parts by weight of the toner material were admixed with 95 parts by weight of powdery iron carrier in a shaking apparatus to prepare a developing agent. It was confirmed through microscopic observation for either toner material that the developing agent contained no ruptured toner particles.

A conventional electrostatographic copying and duplicating process was carried out using the above developing agent. The visible toner image produced on a latent image was then converted onto a paper. The paper carrying the toner image was treated under a pressing roller at a pressure of 350 kg./cm$^2$. There was obtained a toner image with high sharpness and well fixed onto the paper for either toner material. Further, off-setting of the toner was at a very low level for either toner material.

Example 2

In a dispersion of 1 g. of carbon black in 13 cc. of tricresyl phosphate was dissolved 1 g. of an adduct of tolylene diisocyanate with hexanetriol (3:1 molar ratio adduct) to prepare a primary liquid.

Independently, 7 g. of polyvinyl alcohol was dissolved in 100 cc. of water to prepare a secondary liquid.

The primary liquid was dropped into the secondary liquid under stirring to disperse very small droplets of the primary oily liquid in the secondary liquid. The mixture was further emulsified under stirring at room temperature for approximately 2 hours followed by stirring at 80° C. for approximately 1 hour. While the stirring was carried out, the diisocyanate adduct reacted with water to produce insoluble shells enclosing the oily droplets to yield encapsulated toner particles.

The so prepared dispersion was divided into two portions, that is, D and E. The slurry portion D was subjected to centrifugal separation at 5,000 r.p.m. to separate the encapsulated particles from the polyvinyl alcohol-containing aqueous solution. The separated particles were then dispersed in an aqueous solution of an anionic surface active agent having the formula:

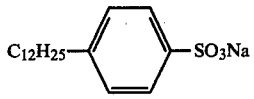

in water (concentration: 0.5 wt. %), and the particles were again separated from the aqueous phase through the centrifugal separation. The particles were further washed with a simple water in the same manner.

To each of the portions D and E were added 100 cc of water, and the resulting slurry was dried in a spray-drying apparatus to obtain a powdery encapsulated toner material.

Each of the toner materials obtained from the portions D and E were examined on the powder characteristics. Microscopic observation on the toner materials indicated that the toner material D showed powder characteristics superior to the toner material E, and that the toner material D had excellent flow property.

The toner material D was evaluated on the property required for a developing agent in the same manner as in Example 1 through the developing and fixing processes.

There was obtained a toner image with high sharpness and well fixed onto the paper. Further, off-setting of the toner was at a very low level.

Example 3

A solution of 4 g. of polythiol-type polysulfide resin (Thiokol LP-2, trade mark of Thiokol Corporation) in 10 g. of methylene chloride was mixed with a dispersion consisting of 15 g. of magnetite powder, 1 g. of carbon black, and 14 g. of dibutyl phthalate to prepare a primary liquid. To the primary liquid were added 6 g. of diphenylmethane-4,4'-diisocyanate and 0.05 g. of N,N-dimethylbenzylamine (catalyst) to prepare a secondary liquid.

Into a solution of 4 g. of gum arabic and 0.5 g. of Turkey red oil in 20 g. of water at 15° C. under vigorous stirring was poured little by little the secondary liquid. Thus, there was obtained an oil-in-water type emulsion containing oily droplets having average diameter of 10–15 μm. The procedure for the preparation of the emulsion was carried out under cooling the reaction vessel for keeping the temperature of the emulsion below 15° C.

To the emulsion was further added under stirring 100 g. of water heated to 60° C. After completion of the addition of water, the emulsion was gradually heated to 95° C. over 30 min. The emulsion was then kept under stirring at the temperature for 60 min. so as to complete the encapsulating reaction.

The so prepared dispersion was subjected to centrifugal separation in the same manner as in Example 1 to separate the encapsulated particles from the gum arabic-containing aqueous solution. The separated slurry containing the encapsulated particles was divided into two portions, that is, F and G.

The portion F was washed with an aqueous solution of a nonionic surface active agent having the formula:

$$C_{12}H_{25}—O—(CH_2.CH_2O)_{10}H$$

in water (concentration: 2 wt. %), and the portion G was left untreated.

To each portion was added 100 cc of water, and the resulting slurry was dried in a spray-drying apparatus to obtain a powdery encapsulated toner material.

Each of the toner materials obtained from the portions F and G was examined on the powder characteristics. Microscopic observation on the toner materials indicated that the toner material F showed powder characteristics superior to the toner material G, and that the toner material F had excellent flow property.

A conventional electrostatographic copying and duplicating process based on the one-component developing process was carried out using the toner material F. The visible toner image produced on a latent image was then converted onto a paper. The paper carrying the toner image was treated under a pressing roller at a pressure of 350 kg./cm$^2$. There was obtained a toner image with high sharpness and well fixed onto the paper. Further, off-setting of the toner was at a very low level.

We claim:

1. In a process for the preparation of an electrostatographic toner material comprising encapsulating a core material containing colorant with a shell material in an aqueous medium in the presence of a hydrophilic protective colloid to prepare encapsulated toner particles and drying the so prepared encapsulated toner particles, the improvement which comprises washing the encapsulated toner particles with an aqueous solution containing 0.3 to 10 percent by weight of at least one surface active agent selected from the group consisting of an anionic surface active agent and a nonionic surface active agent in advance of subjecting them to the drying procedure.

2. The process as claimed in claim 1, in which the concentration of the surface active agent in the aqueous solution ranges from 0.5 to 2 percent by weight.

3. The process as claimed in claim 1, in which the encapsulation of the core material is accomplished by an interfacial polymerization method.

4. The process as claimed in claim 3, in which the interfacial polymerizaton is accomplished using polyisocyanate and polyol, polyamine, or mixtures thereof.

5. The process as claimed in claim 1, in which the encapsulation of the core material is accomplished by an inner polymerization method.

* * * * *